US006363685B1

(12) United States Patent
Kugler

(10) Patent No.: US 6,363,685 B1
(45) Date of Patent: Apr. 2, 2002

(54) METHOD AND APPARATUS FOR SELECTIVELY ADJUSTING THE ELEVATION OF AN UNDULATING OR PLANNAR SURFACE

(76) Inventor: William E. Kugler, 2989 S. Detroit Way, Denver, CO (US) 80210

( * ) Notice: Subject to any disclaimer, the term of this patent is extended or adjusted under 35 U.S.C. 154(b) by 0 days.

(21) Appl. No.: 09/575,335

(22) Filed: May 19, 2000

(51) Int. Cl.[7] ..... E04G 21/14; E04F 15/024

(52) U.S. Cl. ..... 52/745.05; 52/126.6

(58) Field of Search ..... 52/126.1, 126.2, 52/126.5, 126.6, 126.7, 741.1, 741.15, 745.05; 254/13, 92, 98, 102, DIG. 8; 248/188.4, 188.5, 354.1, 354.3, 357

(56) References Cited

U.S. PATENT DOCUMENTS 3,157,254 A * 11/1964 Spiselman et al. ..... 52/126.6
3,222,030 A * 12/1965 Thorpe ..... 52/126.6
3,398,933 A * 8/1968 Haroldson ..... 52/126.6
4,558,544 A * 12/1985 Albrecht et al. ..... 52/126.6
4,780,571 A * 10/1988 Huang ..... 52/126.6
5,588,264 A * 12/1996 Buzon ..... 52/126.6

* cited by examiner

*Primary Examiner*—Michael Safavi
(74) *Attorney, Agent, or Firm*—Sheridan Ross P.C.

(57) ABSTRACT

An adjustable support piece is provided which can selectively raise or lower the level of a building surface or industrial component such as a mechanical pump, etc. A base member, crown member, and threaded tubular stem which can be cut with a hand saw are provided and which can be selectively adjusted in height to raise or lower the height of the building surface. In one embodiment, a coupling may be used to interconnect two tubular stems together. Further, a crown coupling spacer may be used to moderately increase the total length of the adjustable support piece.

16 Claims, 6 Drawing Sheets

METHOD AND APPARATUS FOR SELECTIVELY ADJUSTING THE ELEVATION OF AN UNDULATING OR PLANNAR SURFACE

FIELD OF THE INVENTION

The present invention relates to construction apparatus, and more specifically a device which can be used to selectively adjust the height and level of a building surface such as a walk, deck or porch during the construction therein.

BACKGROUND OF THE INVENTION

During the construction of patios, decks, floors and other building surfaces, it is imperative that a level surface or a surface with a gradual, consistent grade be maintained. This is most often accomplished over ground surfaces which are uneven, non-level and difficult to work with. Previous attempts have been made by builders to effectively eliminate this problem, including leveling the uneven surface by hand or with machinery, using wedge shims, spacers and selectively cutting numerous vertical support work pieces until the proper length and resultant grade is obtained. Unfortunately, all of the aforementioned methods are time consuming, generally ineffective and expensive.

One possible solution to the aforementioned problem was disclosed in U.S. Pat. No. 5,588,264 to Buzon (hereinafter the '264 patent). In the '264 patent, a leveling device was disclosed which included a tubular stem which was threadingly coupled with a crown member and a foot member. To adjust the elevation of a work surface such as a patio deck, the tubular stem was rotated either counter clockwise into a base member to increase the height of the leveling device, or rotated clockwise to decrease the height of the leveling device. This device allowed portions of the work surface to be raised or lowered quickly and effectively without having to ad shims, move dirt or cut additional lumber or other materials. The devices disclosed and covered in the '264 patent have a specific limited range of height since differing units can only be raised within a range of approximately 3 inches. Thus, the device is very limited in use and one unit cannot be used in the majority of situations where a custom fit piece was required to level a building surface. Further, no type of non-skid shim plates were provided in the '264 patent to prevent shifting of the building surface resting on the adjustable leveling device. Additionally, no attachable shims or couplings are provided to quickly modify the total height of the adjustable leveling device or bring the support element into a more vertical position. Thus, the use of shims and other make-shift work pieces are often required in combination with the leveling apparatus which is both time consuming and quite ineffective.

Thus, there is a strong need in the construction trades and industry in general for a leveling device which is simplistic to use, is stable, can be modified on site with common hand tools, and which can be expandable with a variety of accessory components to provide a wide range of selectively adjustable lengths.

SUMMARY OF THE INVENTION

It is thus one object of the present invention to provide an adjustable leveling apparatus which can be modified quickly and easily with a portable hand saw to accommodate a variety of different lengths to support a deck porch floors or mechanical equipment (such as pumps) or other similar building surfaces. The leveling device can be used independently, or more commonly with a plurality of other adjustable support devices to create a level surface or a surface with a slight grade for drainage purposes.

It is another object of the present invention that the leveling device be selectively expandable to a much greater length by the use of a coupling mechanism which allows the interconnection of at least two distinct lengths of tubular stem material. Additionally, in another aspect of the present invention the tubular stem is integrally interconnected to a base member. In this configuration the total length of the adjustable support piece is significantly reduced and can be used in situations where the vertical clearance between an upper building surface and a lower surface is less than about three inches.

In another aspect of the present invention, a base member is provided which supports the tubular stem and crown member, and which has a greatly increased and widened base surface to provide stability. Further, the base member may have a plurality of drainage weep holes to allow water to drain through the substrate to avoid freezing and potential breakage. Further, a plurality of attachment apertures may be provided to receive nails, screws and other attachment hardware to allow the base member to be interconnected to a lower building surface.

It is a further object of the present invention to provide a crown member which is screwed onto the tubular stem member and which can be raised or lowered to selectively adjust the total height of the leveling apparatus. The top of the crown member preferably includes a plurality of alignment tabs which are used to align the construction materials such as a wood deck panel, a patio paver, cement block or framing joist. Alternatively, one or more of the tabs can be quickly removed to provide a flat support surface.

It is a further object of the present invention to provide a removable crown coupling member which matingly engages the upper planar surface of the crown member to provide slightly more length to the adjustable support piece. Preferably, the crown coupling member has a plurality of vertically extending alignment tabs which are used to align the building surface. Further, a non-skid pad may be provided which fits on either the upper planar surface of the crown coupling member. The non-skid pad is preferably made of a rubber, and has a sufficient coefficient of friction to prevent the deck panels or stone pavers or other common materials from shifting on the adjustable support piece after installation.

Thus, in one aspect of the present invention, a method for selectively adjusting a height of a building surface is provided, comprising the steps of:

determining the approximate height requirement of the building surface;

cutting a threaded first tubular stem to accommodate said approximate height requirement;

screwing a base member to a first end of said first threaded tubular stem and a crown member to a second end of said first threaded tubular stem to form an adjustable support piece;

positioning said adjustable support piece in a substantially perpendicular relationship between a first horizontal surface and a second horizontal surface which defines at least a portion of the building surface; and adjusting a total length of said adjustable support piece to an optimum desired height, wherein the building surface can be leveled or provided a predetermined grade.

DETAILED DESCRIPTION

Figure 1:
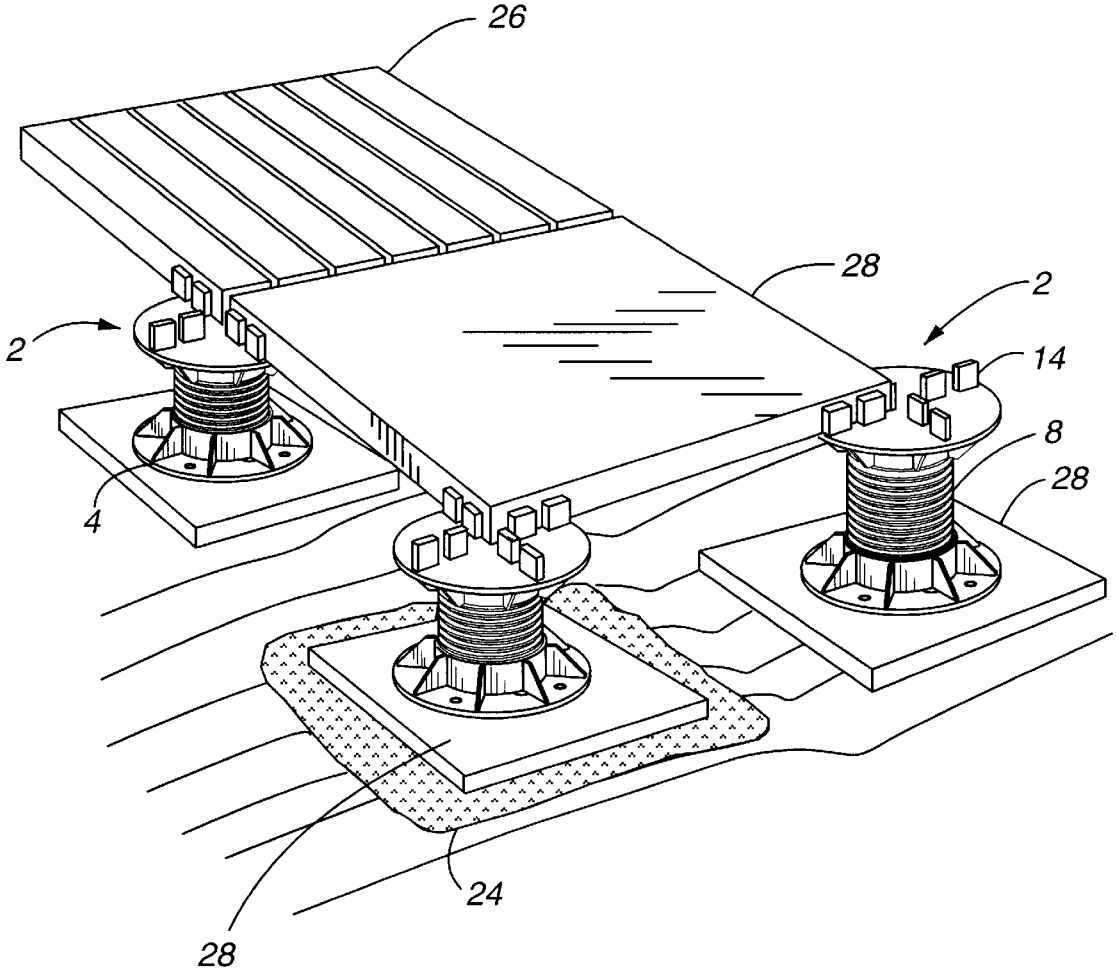
FIG. 1 is a front perspective view of the present invention being used to support a building surface such as wood decking and/or concrete pavers.

Referring now to the drawings, FIG. 1 identifies three adjustable support pieces 2 of the present invention positioned below a building surface to provide support therein. As seen in this drawing, the support pieces 2 are typically positioned between a substantially planar surface of a lower building surface and an upper building surface such as a patio deck. For example, a concrete paver 28 may be positioned on top of compacted soil 24 to provide a lower support surface while a concrete paver 28 or alternatively wood decking material 26 is positioned on top of the adjustable support piece 2 to provide an upper building surface. Depending on the uneven elevation of the compacted soil 24, it is necessary for the various comers of the adjustable support pieces 2 to be independently raised and/or lowered to effectively obtain a level building surface. Thus, as seen in FIG. 1, the adjustable support piece 2 on the right hand comer is raised to a greater elevation than the adjustable support piece 2 positioned in the middle due to the lower elevation of the compacted soil 24 shown on the right hand portion of the drawing.

Figure 2:
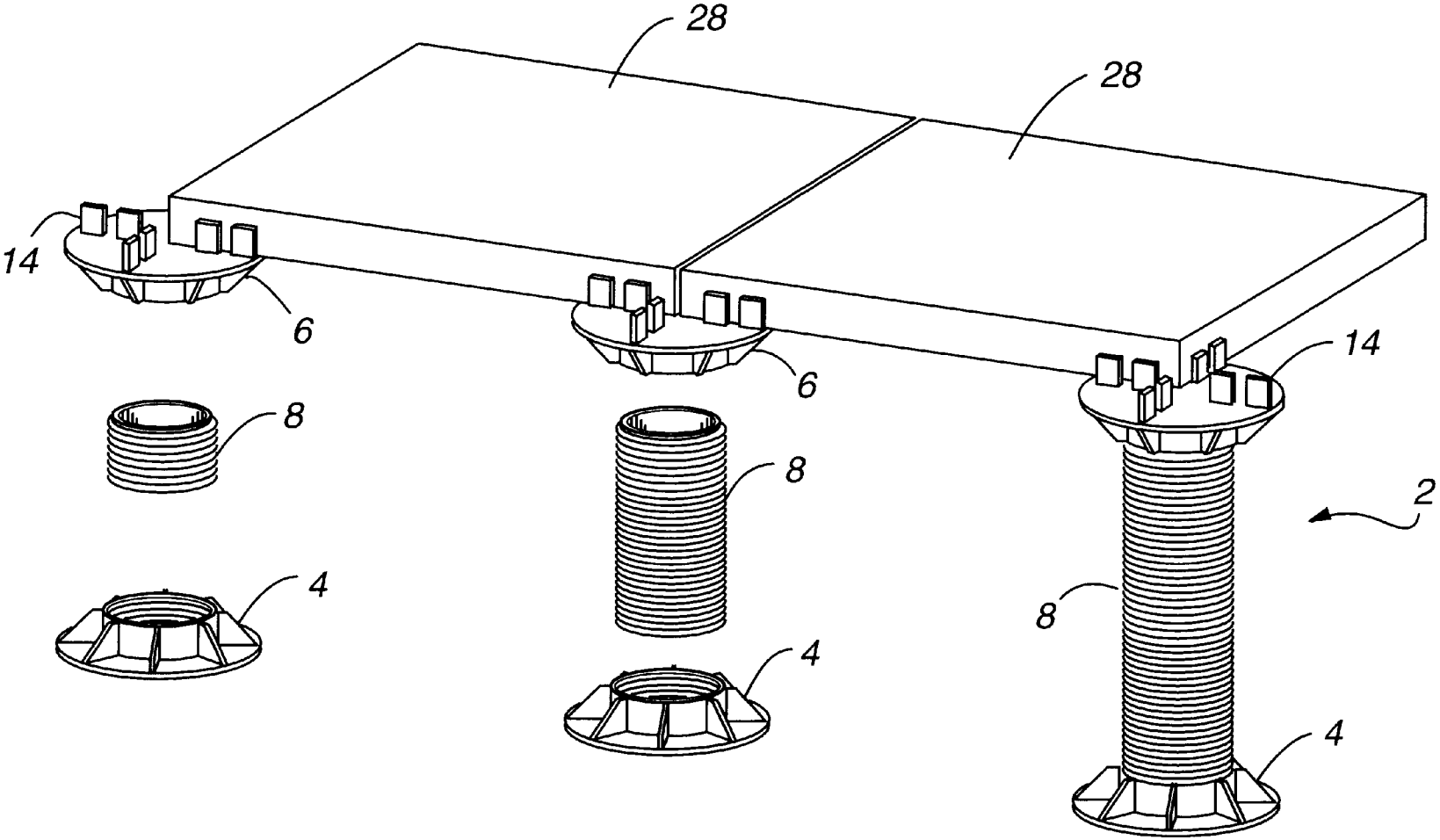
FIG. 2 is a front perspective view showing the adjustable support piece in various stages of assembly and supporting a building surface.

Referring now to FIG. 2, the adjustable support piece 2 is generally shown being used to support two concrete pavers 28 and further identifying exploded views of the adjustable support piece 2. More specifically, the adjustable support piece 2 is comprised of a base member 4, a tubular stem 8, and a crown member 6 which is interconnected to the upper portion of the tubular stem 8. For assembly purposes, the tubular stem 8 is threadingly engaged to inner integral threads 10 positioned within the base member 4 on a lower end, and on an upper end to a crown member 6 which additionally has integral vertical threads 10 extending therefrom. Generally, the tubular stem 8 has an original length at least about 4 times greater than the height of each of the base member 4 and the crown member 6. In a preferred embodiment, the crown member 6 and base member 4 each have a vertical height of about 1.50 inches, while the tubular stem 8 has an original overall length of approximately 12 inches.

To effectively use the adjustable support piece 2 to selectively level a building surface, an approximate height of the desired total height of the adjustable support piece 2 is calculated depending on the approximate elevated height of the upper building surface. Once this height is determined, the tubular stem 8 is typically cut with a portable hand saw and miter box and/or a power saw such as a sawsall. By effectively cutting the length of the tubular stem 8 for any given application, a significant amount of flexibility can be obtained by creating an adjustable support piece 2 which has a minimum length of about 2.25 inches, and/or a total maximum height using one tubular stem of about 15 inches. This flexibility allows the adjustable support piece 2 to be used in a wide variety of applications to effectively support a building surface such as a patio deck.

Figure 3:
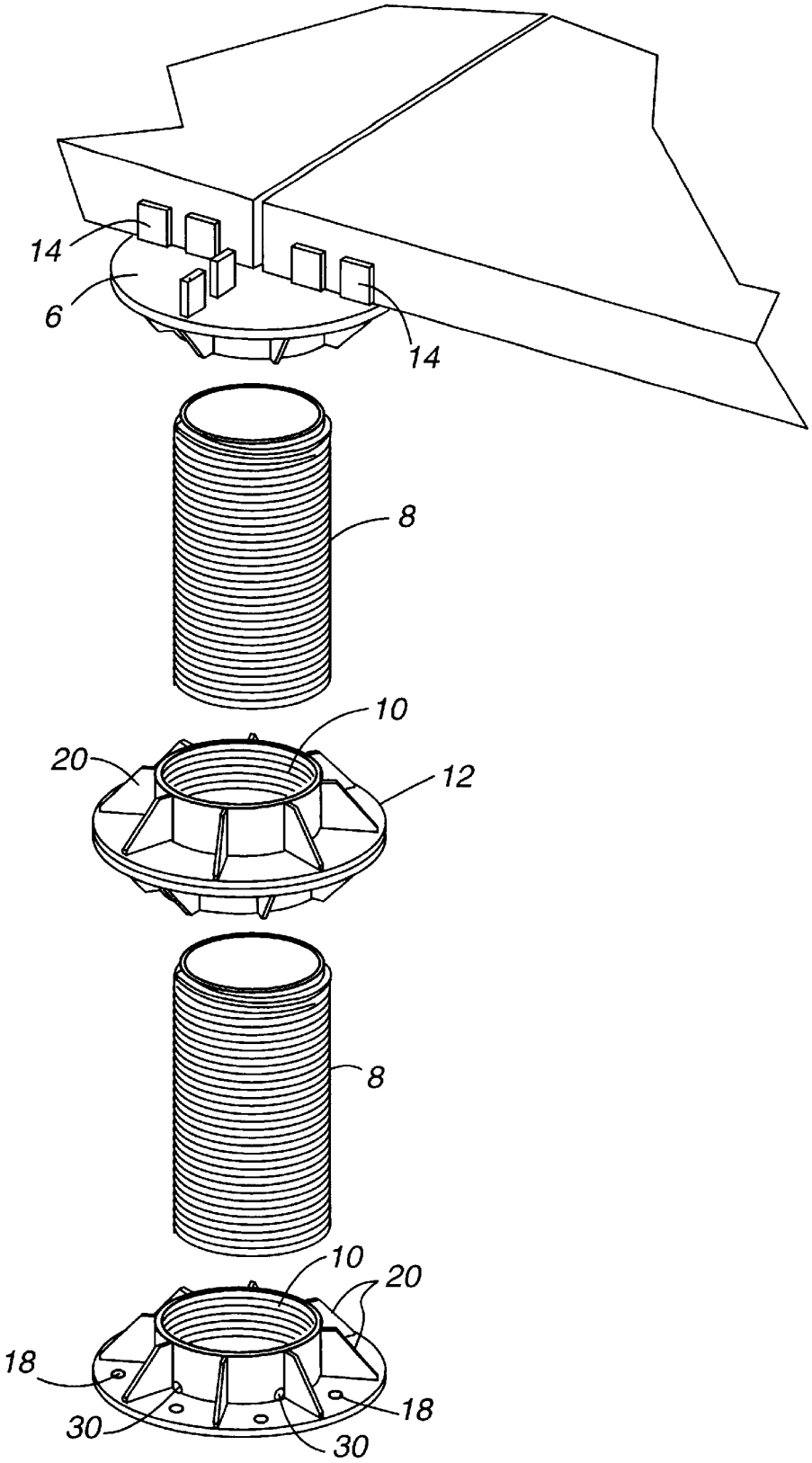
FIG. 3 is an exploded view of the adjustable support piece showing the base member, two tubular stems for interconnection with a coupling, and a crown member for interconnection to the upper tubular stem.

In an alternative embodiment of the present invention shown in FIG. 3, two separate tubular stems 8 may be interconnected by the use of a threaded coupling 12 to make an adjustable support piece 2 having a length effectively two times longer than an adjustable support piece 2 which utilizes only one tubular stem 8. This flexibility is especially beneficial in applications where there is a significant elevation differential between one position of a building surface and another.

The base member 4 is generally comprised of a plastic material such as polyethylene or nylon which is resistant to mold, mildew, and rotting when exposed to moist conditions. In general, the base member 4 has a substantially planar lower surface adapted for resting on an opposing flat surface such as a concrete paver or ground surface. Extending upwardly from the substantially planar surface is a vertical cylindrical member with integral threads 10 positioned therein which are adapted for receiving the tubular stem 8. For reinforcement and support purposes a plurality of support fins 20 preferably interconnect the vertically extending tubular piece of the base member 4 to the substantially planar member on the bottom. In a preferred embodiment, the width of the base member 4 is about 8 inches although lengths between about 6 inches and 12 inches would be quite effective. As further seen in FIG. 3, the base member 4 may additionally have a plurality of drainage weep holes 30 to allow water to drain from within the base member 4. Additionally, a plurality of base apertures 18 may be provided to receive a nail, screw, or other piece of attachment hardware to interconnect the base member 4 to a lower building surface such as a wood beam, or concrete paver. Additionally, gloves or adhesive may be used to attach the base member 4 to a lower building surface in certain applications.

The tubular stem 8 is preferably comprised of a plastic material such as a polyethylene, polypropylene, nylon, or other similar material. Preferably the tubular stem 8 has integral threads extending from a first lower end to a second higher end, with a rate of twist of approximately 5 threads per inch. The tubular stem has a preferred normal diameter of between about 3 inches and 5 inches and more preferably about 4 inches. Additionally, the tubular stem 8 has a length of at least about four times the vertical height of either the base member 4 and crown member 6. This increased initial length of the tubular stem 8 allows the assembled adjustable support piece 2 to be used initially in applications requiring a support piece with a length of about 24 inches, or the tubular stem can be quickly cut with a hand saw to provide a support piece 2 with a length of only about 2.25 inches.

Referring again to FIG. 3, the threaded coupling 12 is designed to be positioned between two tubular stem members 8 to effectively increase the overall length of the adjustable support piece 2. Similar to the base member 4 and crown member 6, the threaded coupling 12 is preferably constructed of a plastic material such as polyethylene, polypropylene, nylon or other similar materials known in the art and which effectively has a diameter which is substantially equivalent to the crown member 6 or base member 4.

Additionally, a plurality of support fins 20 may be used to provide structural support to the threaded coupling 12.

The crown member 6 is sized and designed to be threaded onto the upper end of the tubular stem 8. The crown member 6 has a substantially planar upper surface which is interconnected to a cylindrical member which has a plurality of integral threads extending downwardly to receive the tubular stem 8. Similar to the base member 4, a plurality of support fins 20 may be used to provide structural support between the substantially planar upper surface and the downwardly extending integral threaded portion. Additionally, the substantially planar upper surface of the crown member 6 may include a plurality of alignment tabs 14 which are oriented at substantially right angles. The alignment tabs 14 are designed to abut an edge surface of a concrete paver 28, wood decking material 26 or any other type of building surface. Preferably, the alignment tabs 14 are comprised of a brittle plastic material which are integrally interconnected to the upper planar surface of the crown member 6 during manufacturing. The alignment tabs 14 are brittle to allow an installer to selectively break off one or more of the alignment tabs 14 during installation. Further, all of the alignment tabs 14 may be quickly broken off by the use of a hammer or other similar tool to provide a substantially flat surface.

Figure 4:
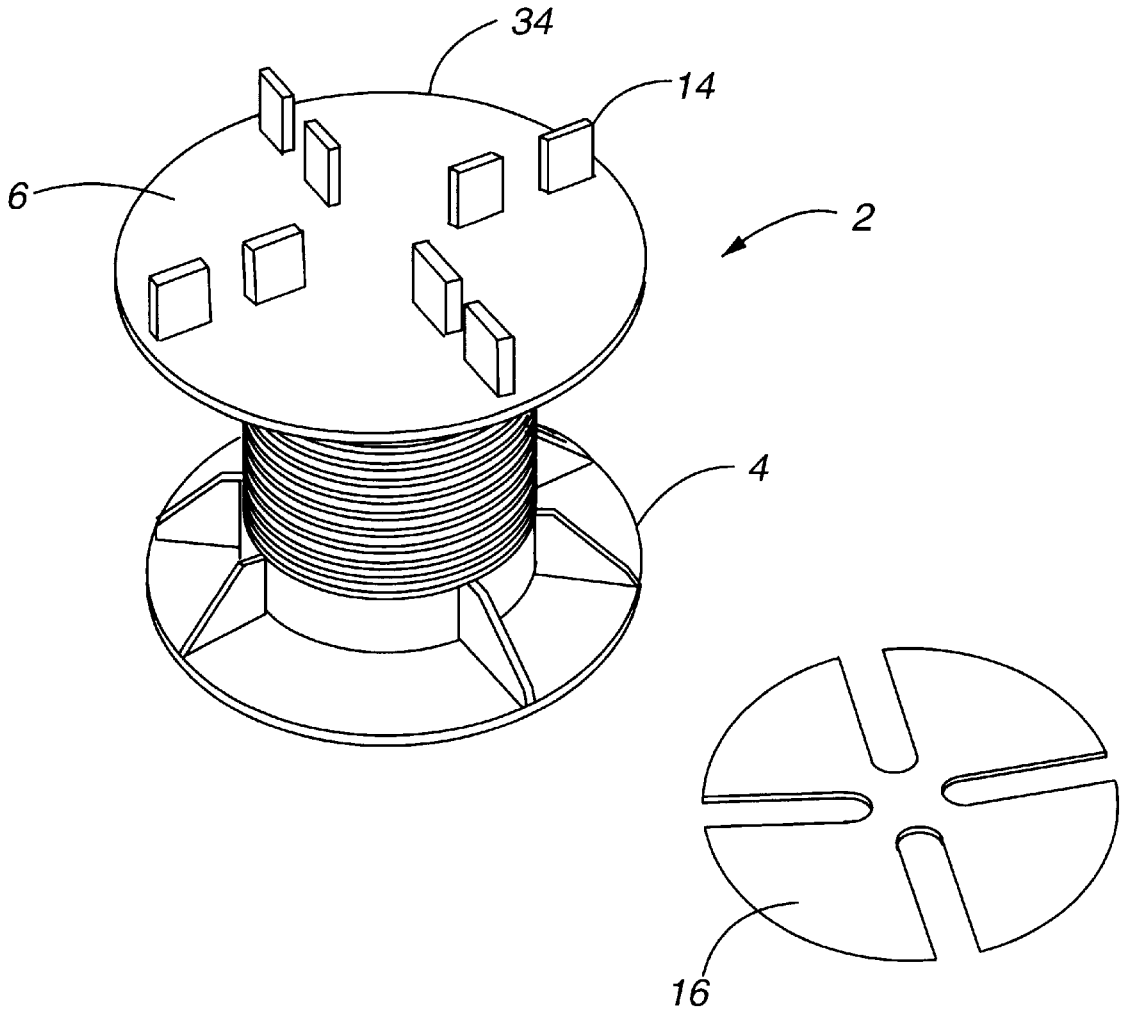
FIG. 4 is a front perspective view of an assembled adjustable support piece and identifying a non-skid shim plate which fits on the upper planar surface of the crown member.

Reffering now to FIG. 4, an upper perspective view of an assembled adjustable support piece 2 is provided along with a non-skid shim pad 16 shown to the right. The non-skid shim pad 16 is preferably comprised of a rubber type material which fits on the upper planar surface of the crown member 6. The slots positioned in the non-skid shim pad 16 are designed to matingly fit around the alignment tabs 14. When in place, the non-skid shim pad 16 effectively prevents the concrete pavers 28 or other building materials from sliding and slipping on top of the plastic upper planar surface of the crown member 6. Although other type of materials could be used for the same purpose such as felt, cloth fabrics and other similar materials appreciated by one skilled in the art, products which have a substantially high coefficient of friction are most desirable.

Figure 5:
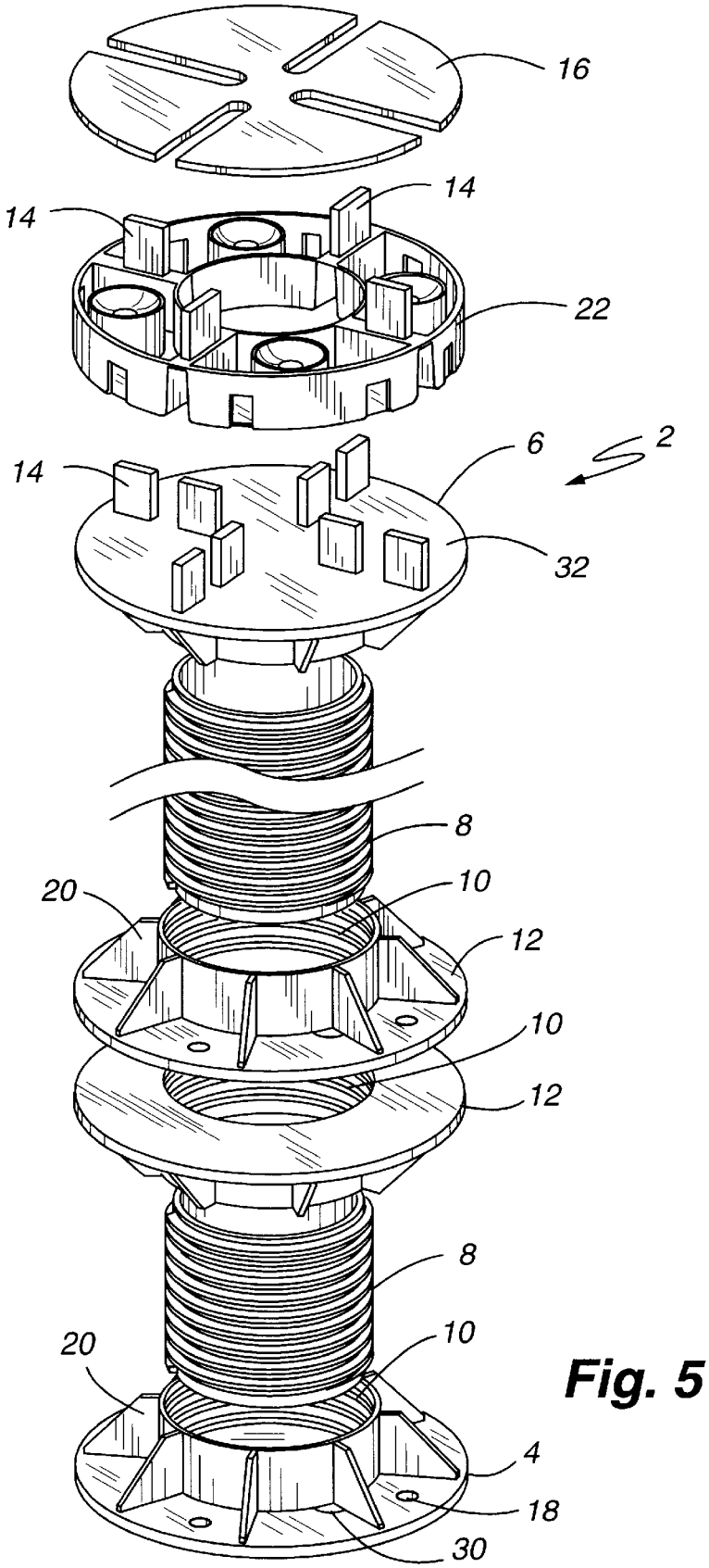
FIG. 5 is an exploded view of the adjustable support piece and further identifying a crown coupling member which matingly engages the upper planar surface of the crown member to provide a slight increase in the total length of the adjustable support piece.

Referring now to FIG. 5 the adjustable support piece 2 is shown in an exploded view which identifies the base member 4, the tubular stem 8, the crown member 6, and a crown spacer 22 positioned on top of the crown member 6 and below the non-skid shim pad 16. The crown spacer 32 is designed to matingly engage the upper surface of a typical crown member 6 by fitting around the alignment tabs 14, and thus providing approximately 0.75 inches in increased height to the adjustable support piece 2. In a preferred embodiment the crown spacer 22 is about 0.5–0.75 inches high, although lengths ranging from about 1 inch to 4 inches may be used. Additionally, the crown spacer 22 preferably has a plurality of alignment tabs 14 extending vertically therefrom which are similar to the crown member 6, and are used for the same purpose to prevent movement of the building surface.

Figure 6:
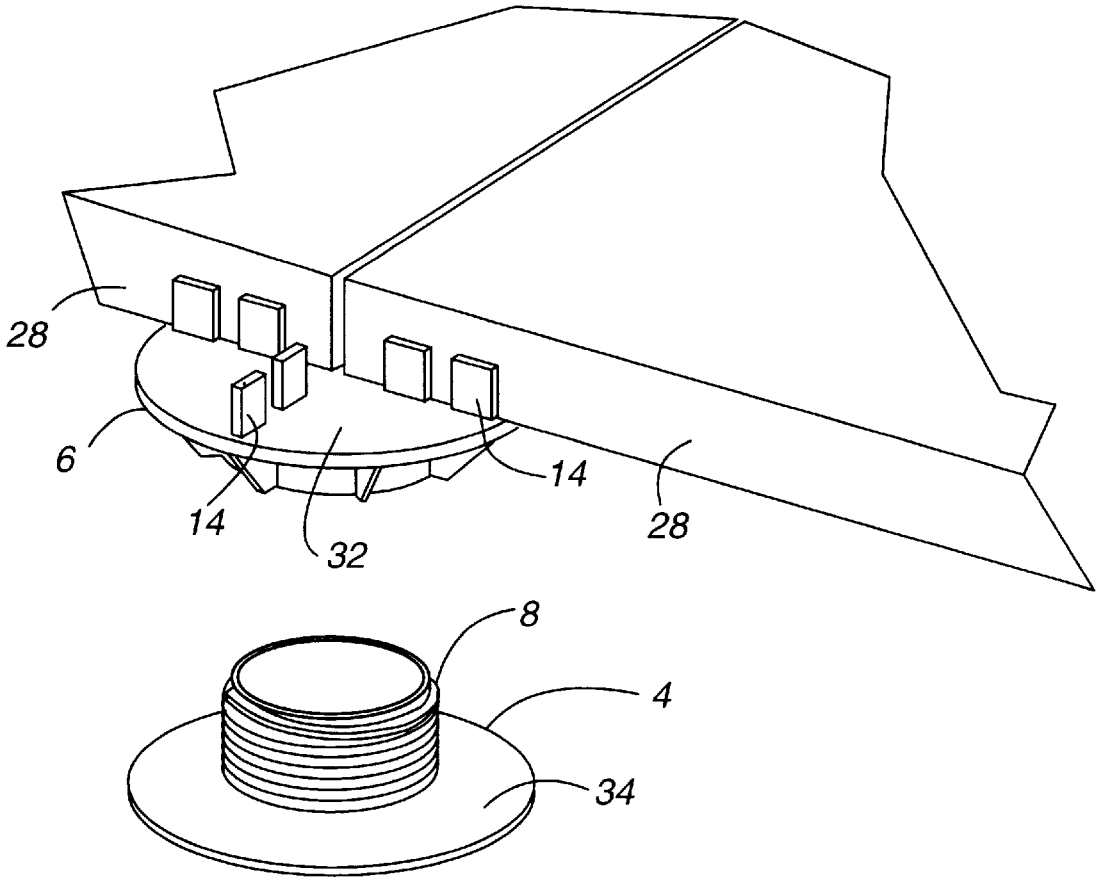
FIG. 6 is a front perspective view of an alternate embodiment of the present invention where the tubular stem is integrally interconnected to the base member, thus reducing the total height of the adjustable support piece.

Referring now to FIG. 6, an alternative embodiment of the present invention is provided. More specifically, a front perspective view is shown with the crown member 6 disconnected from the tubular stem 8 and base member 4. However, as shown in the drawing the tubular stem 8 is integrally interconnected to an upper planar portion of the base member 4, as opposed to being an independent component as seen in FIGS. 1–4. This embodiment allows the crown member 6 to be screwed down over the tubular stem 8 until contact is made with the upper planar surface of the base member 4, and thus significantly reducing the total length of the adjustable support piece 2. In fact, the total length between the lower planar surface of the base member 4 and the upper planar surface of the crown member 6 is only 2.25 inches. Thus, this configuration allows the adjustable support piece to be used in locations where the total vertical distance between the upper building surface and lower building surface is very small, i.e., less than about 2.5 inches.

For clarity purposes, a detailed list of the various components of the present invention and the associated numbering is provided herein.

| Number | Component |
|---|---|
| 2 | Adjustable support piece |
| 4 | Base member |
| 6 | Crown member |
| 8 | Tubular stem |
| 10 | Threads |
| 12 | Threaded coupling |
| 14 | Alignment tabs |
| 16 | Non-skid shim pad |
| 18 | Base apertures |
| 20 | Support fins |
| 22 | Crown spacer |
| 24 | Compacted soil |
| 26 | Wood decking |
| 28 | Concrete paver |
| 30 | Drainage weep holes |
| 32 | Crown member upper planar surface |
| 34 | Base member upper planar surface |
| 36 | Tubular stem first end |
| 38 | Tubular stem second end |

While various embodiments of the present invention have been described in detail, it is apparent that modification and adaptations of those embodiments will occur to those skilled in the art. However it is to be expressly understood that such modification and adaptations are within the scope of the present invention as set forth in the following claims.

What is claimed is:

1. A method adapted for selectively adjusting a height of a building surface, comprising the steps of determining an approximate height requirement of the building surface;

cutting a threaded first tubular stem to accommodate said approximate height requirement;

interconnecting said first tubular stem to a threaded second tubular stem with a coupling positioned therebetween to form an adjustable support piece;

screwing a base member to said first threaded tubular stem and a crown member to said threaded second tubular stem to form an adjustable support piece;

positioning said adjustable support piece in a substantially perpendicular relationship between a lower horizontal surface and an upper horizontal surface which defines at least a portion of the building surface; and adjusting a total length of said adjustable support piece to an optimum desired height, wherein the upper horizontal surface can be positioned to a desired level.

2. The method of claim 1, wherein said threaded tubular stem has at least a three inch nominal diameter.

3. The method of claim 1, wherein said threaded first tubular stem has a total length prior to cutting at least four times the length of said base member or said crown member.

4. The method of claim 1, further comprising the step of aligning a vertical edge of said upper horizontal surface along a plurality of alignment tabs extending vertically upward from an upper planar surface of said crown member.

5. The method of claim 1, further comprising positioning a non-skid shim pad on an upper surface of said crown member to inhibit shifting of the building surface.

6. The method of claim 1, wherein said adjustable support piece is capable of supporting a load of at least about 2000 lbs.

7. The method of claim 1, further comprising the step of securing said base member to the lower horizontal surface.

8. The method of claim 7, wherein said step of securing comprises inserting a screw or nail through an engagement hole in said base member and penetrating the lower horizontal surface.

9. The method of claim 1, further comprising the step of positioning a crown spacer on an upper surface of said crown member to increase said total length of said support piece.

10. An adjustable support piece for selectively adjusting the elevation of a building surface, comprising:

a base member having a substantially planar bottom surface, a first height, and a plurality of integral threads positioned vertically upward along a longitudinal axis of said adjustable support piece;

a crown member having a substantially planar upper surface with a plurality of vertically extending alignment tabs extending upwardly therefrom, and a plurality of integral threads extending vertically downward along said longitudinal axis of said adjustable support piece;

a first tubular stem having a first end, a second end and a length at least four times the length of said first height of said base member and constructed of a material capable of being cut with a hand saw, said first threaded tubular stem sized for threading engagement with a coupling;

a second tubular stem having a first end and a second end, said first end sized for threading engagement to an upper end of said coupling and said second end sized for threading engagement with said integral threads of said crown member, wherein said base member and said crown member when interconnected to said first and said second tubular stems define said adjustable support piece with a length which can be selectively modified to change the elevation of the building surface positioned on top of said adjustable support piece; and a removable, rigid crown spacer having a lower surface which matingly engages said upper surface of said crown member and having a plurality of upwardly extending alignment tabs to align said building surface, wherein the total length of said adjustable support piece can be selectively increased or decreased.

11. The adjustable support piece of claim 10, wherein at least one of said first tubular stem and said second tubular stem are comprised of a plastic material.

12. The adjustable support piece of claim 10, further comprising a non-skid shim pad sized to fit on said substantially planar top surface of said removable, rigid crown spacer to inhibit any shifting of the building surface.

13. The adjustable support piece of claim 10, wherein said base member has a plurality of apertures sized to receive a nail or screw, wherein said base member can be secured to a lower building surface.

14. The adjustable support piece of claim 10, wherein said plurality of vertically extending alignment tabs are sufficiently brittle to be selectively broken off of the upper surface of said crown member.

15. A method for leveling a building surface, comprising the steps of:

a) estimating an approximate height of said building surface;

b) cutting a first threaded tubular stem to a first length;

c) interconnecting a first end of said threaded tubular stem to a base member which has a substantially planar lower surface and interconnecting a second end of said threaded tubular stem to a lower end of a coupling;

d) interconnecting a first end of a second threaded tubular stem to an upper end of said coupling and a second end of said second threaded tubular stem to a crown member having a substantially planar upper surface with a plurality of alignment tabs extending therefrom to create an adjustable support member;

e) positioning a crown spacer on an upper surface of said crown member to increase a total length of said crown member, said crown spacer having a plurality of alignment tabs extending vertically therefrom;

f) positioning a portion of said building surface on said substantially planar surface of said crown spacer adjacent to at least one of said plurality of alignment tabs; and g) turning at least one of said first or said second tubular stems to selectively raise or lower said building surface to a preferred position.

16. The method of claim 15, further comprising the step of positioning a non-skid member on said crown spacer to inhibit any movement of the building surface.

* * * * *

UNITED STATES PATENT AND TRADEMARK OFFICE

CERTIFICATE OF CORRECTION

PATENT NO. : 6,363,685 B1
DATED : April 2, 2002
INVENTOR(S) : Kugler

It is certified that error appears in the above-identified patent and that said Letters Patent is hereby corrected as shown below:

Title page,
Item [54], should read:

-- [54] METHOD AND APPARATUS FOR SELECTIVELY ADJUSTING THE ELEVATION OF AN UNDULATING OR PLANAR SURFACE --

Signed and Sealed this

Twenty-fourth Day of September, 2002

*Attest:*

*Attesting Officer*

JAMES E. ROGAN
*Director of the United States Patent and Trademark Office*